US005215163A

United States Patent [19]

Kent, Sr. et al.

[11] Patent Number: 5,215,163

[45] Date of Patent: Jun. 1, 1993

[54] LADDER SUPPORT

[76] Inventors: Jack T. Kent, Sr., P.O. Box 29; Aaron J. Kent, P.O. Box 305, both of Calhoun, La. 71225

[21] Appl. No.: 879,576

[22] Filed: May 7, 1992

[51] Int. Cl.[5] ..... E04G 3/00

[52] U.S. Cl. ..... 182/229; 182/214

[58] Field of Search ..... 182/214, 229; 52/11; 248/48.2

[56] References Cited

U.S. PATENT DOCUMENTS

| | | | |
|---|---|---|---|
| 2,710,129 | 6/1955 | Telech | 182/214 |
| 3,072,218 | 1/1963 | Peters | 182/214 |
| 3,288,249 | 11/1966 | Gibson | 182/214 |
| 4,185,421 | 1/1980 | Robinson | 182/214 X |
| 4,601,365 | 7/1986 | Davis | 182/214 X |
| 4,813,515 | 3/1989 | Wigington | 182/214 |

*Primary Examiner*—Blair M. Johnson

*Attorney, Agent, or Firm*—John M. Harrison

[57] ABSTRACT

A ladder support for mounting on the facia board of a structure and securing the top end of a ladder to facilitate access to the roof of the structure. In a preferred embodiment the ladder support includes a pair of spaced legs extending outwardly and upwardly in spaced relationship from fixed attachment to the facia board and a crossbar connecting the extending legs intermediate the ends of the legs. The angle of extension of the legs facilitates clearance of any gutter which might also be mounted on the facia board of the structure and allows placement of the top segment of the ladder against the crossbar to support the ladder at a safe angle with respect to the supporting surface. In another preferred embodiment a sliding bracket is mounted on the crossbar and is fitted with a thumb screw for locking the bracket against one leg of the ladder and further securing the ladder on the crossbar.

5 Claims, 1 Drawing Sheet

LADDER SUPPORT

BACKGROUND OF THE INVENTION

1. Field of the Invention

This invention relates to an improved device for supporting ladders against structures and more particularly, to an improved ladder support which is mounted on the facia board of a structure to prevent shingle, gutter and structure damage from contact by the ladder. In a preferred embodiment the ladder support of this invention is characterized by a pair of legs projecting outwardly and upwardly from fixed attachment to the facia board and connected by a crossbar located intermediate the ends of the legs for receiving and supporting the top of the ladder in functional configuration. In a most preferred embodiment of the invention a sliding bracket is mounted on the crossbar and is fitted with an outwardly-extending, curved plate and a thumb screw for further securing the top end of the ladder on the crossbar. The curved plate is designed to engage a rung of the ladder in the event that the ladder slips on the supporting surface and begins to fall.

One of the problems involving the securing of ladders against a supporting surface or structure to facilitate access to the roof of the structure, is improperly locating the ladder against the structure, gutter or roof line of the structure to provide such access. In addition to creating an unsafe condition where the bottom of the ladder may slip due to an excessive leaning angle, damage to the gutter, shingles or structure itself may occur. Accordingly, there exists in the art a need for a ladder support which is mounted on the structure at an appropriate point in angular relationship to facilitate safe and secure mounting of the upper end of the ladder without damaging the structure walls, gutter, shingles or other structural members.

2. Description of the Prior Art

Typical of the safety devices and brackets known in the art for mounting on ladders to effect safer ascention of the ladder, is a "Safety Bracket for Ladders" detailed in U.S. Pat. No. 1,543,551, dated Jun. 23, 1925, to E. C. Couche, et al. The Couche et al device includes a safety bracket fitted with a pair of J-shaped locking members mounted in slots in the bracket, with outwardly-extending legs for engaging a structure when the ladder is in functional position. U.S. Pat. No. 2,327,317, dated Aug. 17, 1943, to F. D. Randall, details an "Attachment for Ladders" which includes a pair of legs designed for contacting a structure, a telescoping crossbar attached to the legs in adjustable fashion to facilitate leaning of the ladder against a structure having an irregular surface and adjusting mechanisms mounted on the crossbar for securing the ladder to the crossbar. "Mounting and Supporting Devices for Ladders" are detailed in U.S. Pat. No. 2,797,037, dated Jun. 25, 1957, to F. Niedojadlo. The device includes a mounting bracket which is adjustably mounted to the top ends of the ladder and includes outwardly-extending flanges for engaging the structure when the ladder is in functional position. A "Ladder Attachment" is detailed in U.S. Pat. No. 4,061,203, dated Dec. 6, 1977, to Spencer, et al. The attachment enables the upper end of a ladder to be spaced from the wall of a building, span windows and/or rest on a slant roof and thus span the gutters. The device includes a bracket having outwardly-extending, padded legs and a mounting mechanism for securing the bracket to the upper end of the ladder. U.S. Pat. No. 4,369,860, dated Jan. 25, 1983, to Tim E. Beane, details a "Ladder With Bracket Attachments". The ladder includes a pair of brackets that permit the ladder to be leaned against a house without damaging the gutters. The attachments include a pair of bracket members, each of which is constructed of square tubular material and is bent at approximately 20 degrees midway between the ends thereof to define a horizontal leg and a depending leg. The horizontal leg of each bracket is attached to the top rung of a ladder. The opposite depending leg of each bracket has an extensible member threadably engaged therein for inward or outward adjustment and a foot is carried on each extensible member and engages the inside rear wall of the gutter. The depending legs with the extensible members are positioned within the gutter with the feet abutting against the inside rear wall of the gutter. The angle of bend of the brackets facilitates clearance of the depending legs above the top front edge of the front wall of the gutter and the extensible members are adjustable to maintain the ladder away from the gutter, thus preventing damage to the gutter. U.S. Pat. No. 4,394,887, dated Jul. 26, 1983, to Donald E. Spinks, details a "Ladder Standoff Device". The device is adapted to be attached to a ladder and includes an elongated axle fitted with a pair of wheels and an elongated stand-off bar connected in transverse relationship to the axle, with a handle member pivotally attached to the end of the stand-off bar remote from the axle. The stand-off device is attached to a rung of a ladder by a pivot structure mounted on the stand-off bar and includes a fixed foot member and a cooperating sleeve slidable along the stand-off bar. The stand-off device may be locked into position by an attachment member that is slidable along the handle member and adapted to engage in a rung of a ladder different from the rung upon which the device pivots. U.S. Pat. No. 4,444,291, dated Apr. 24, 1984, to L. T. McPherson, details a "Ladder Accessory". The accessory includes a pair of brackets releasably attached to the ladder legs and a pair of downwardly-directed hook portions and associated parts that are sized to be seated in a gutter. The brackets are connected by a crossbar and in a second mode of operation a non-skid, resilient, faced member is attached to the crossbar. Accordingly, the resilient, faced member can be used against aluminum siding and the like to distribute the weight and avoid damage to the exterior wall of the building. U.S. Pat. No. 4,502,566, dated Mar. 5, 1985, to H. R. Wing, details a "Wall Stand-Off Apparatus". The apparatus includes a U-shaped support bar which forms two substantially parallel legs, each of which is provided with an extension member, such that the legs are individually adjustable in length. A pair of clamps are pivotally connected to the support bar and each clamp includes two movable, opposing jaws adapted to be attached to a portion of the ladder which is inserted therebetween. Each clamp includes a thumb screw to firmly secure the clamp to the ladder. A "Gutter Guard" is detailed in U.S. Pat. No. 4,932,498, dated Jun. 12, 1990, to James W. Mileer. The device is designed for mounting on a building for supporting a ladder and protecting the building from damage due to the ladder. It includes multiple legs secured to the structure beneath the gutter and a cross member for receiving and supporting the top portion of a ladder, in order to protect the building or portions of the building such as gutters, roofs and the like, from damage due to the ladder. U.S. Pat. No.

5,010,979, dated Apr. 30, 1991, to Arthur L. Shreve, III, details a "Ladder Stabilizing Device". The ladder stabilizing device includes a U-shaped support bar which forms parallel legs, the ends of which rest against the substantially vertical surface of a structure. The support bars are attached to a levelling device which includes a U-shaped channel and the ends of the levelling device rest against the side rails of the ladder, while the support bar engages the U-shaped channel. The levelling device and support bar are simultaneously attached to the side rails of the ladder and the stabilizing device is removable and holds the ladder away from the substantially vertical surface of a structure, to provide a safe angle of support.

It is an object of this invention to provide a new and improved structure-mounted ladder support for supporting a ladder at a safe angle without damaging the gutters, downspouts, shingles or walls of the structure.

Another object of this invention is to provide a ladder support for mounting on the facia board of a structure and extending above the gutter for stabilizing a ladder and preventing damage to the gutter, downspouts, shingles or walls of the structure.

Still another object of this invention is to provide a ladder support for fixed mounting on the facia board of a structure and a sliding bracket attached to the ladder support for removably securing a ladder in a safe, upright position on the ladder support.

Yet another object of the invention is to provide a ladder support characterized by a pair of spaced leg members projecting from the facia board of a structure in spaced, upwardly-extending relationship and a crossbar connecting the legs intermediate the ends of the legs for receiving the upper end of a ladder and stabilizing the ladder on a supporting surface at a safe operating angle.

A still further object of this invention is to provide ladder support which includes a pair of spaced legs fitted with leg plates for mounting on the gutter mount plate and facia board of a structure and projecting from the mount plates in upwardly-extending, spaced, parallel relationship, a crossbar connecting the legs intermediate the ends of the legs and a sliding bracket having a thumb screw for securing the upper end of a ladder on the crossbar at a safe operating angle with respect to a supporting surface, as well as preventing damage to the shingles, gutter, downspouts or walls of the structure.

SUMMARY OF THE INVENTION

These and other objects of the invention are provided in a new and improved, structure-mounted ladder support, which in a preferred embodiment is characterized by a pair of spaced legs projecting upwardly and outwardly from corresponding leg plates in angular relationship, which leg plates are mounted on the facia board and gutter mount plate of a structure at the points where parallel roof joists terminate at the facia board. The legs extend above the gutter and receive a horizontal crossbar fitted with a sliding bracket having a thumb screw, which sliding bracket is designed to engage the upper end of a ladder in functional position on the crossbar to secure the ladder against one of the legs at a safe operating angle with respect to a supporting surface and prevent damage to the shingles, gutter, downspouts and walls or siding of a structure.

The invention will be better understood by reference to the accompanying drawing, wherein.

DESCRIPTION OF THE PREFERRED EMBODIMENTS

Figure 1:
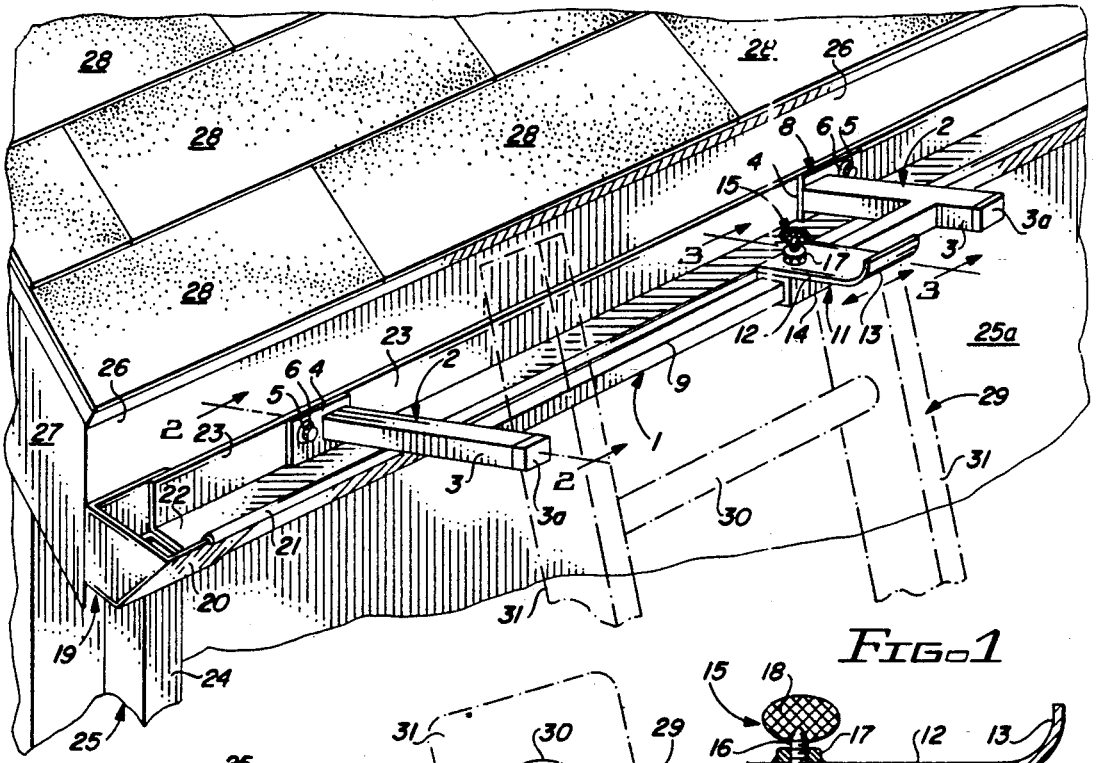
FIG. 1 is perspective view of a preferred embodiment of the ladder support of this invention, with a ladder engaging the ladder support in functional position, as illustrated in phantom.
Figure 2:
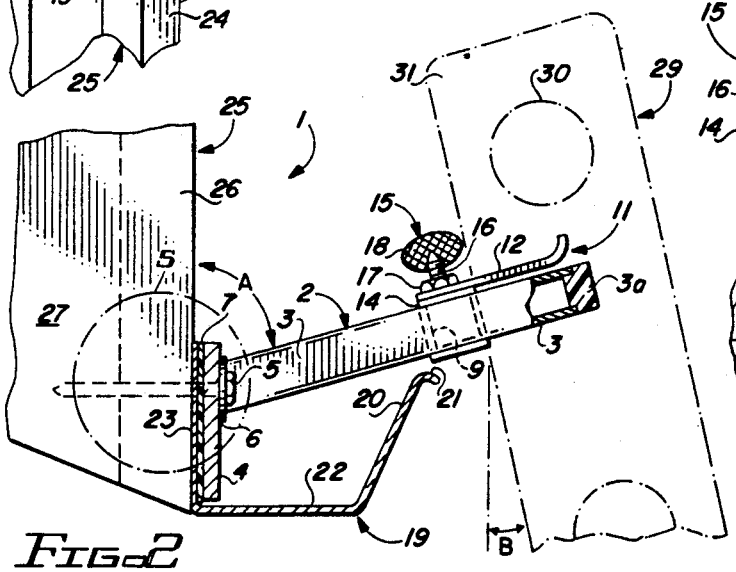
FIG. 2 is a sectional view taken along line 2—2 of the ladder support illustrated in FIG. 1.
Figure 3:
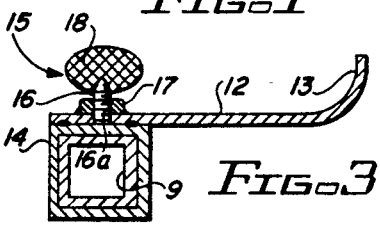
FIG. 3 is a sectional view taken along line 3—3 of a sliding bracket element of the ladder support illustrated in FIG. 1.
Figure 4:
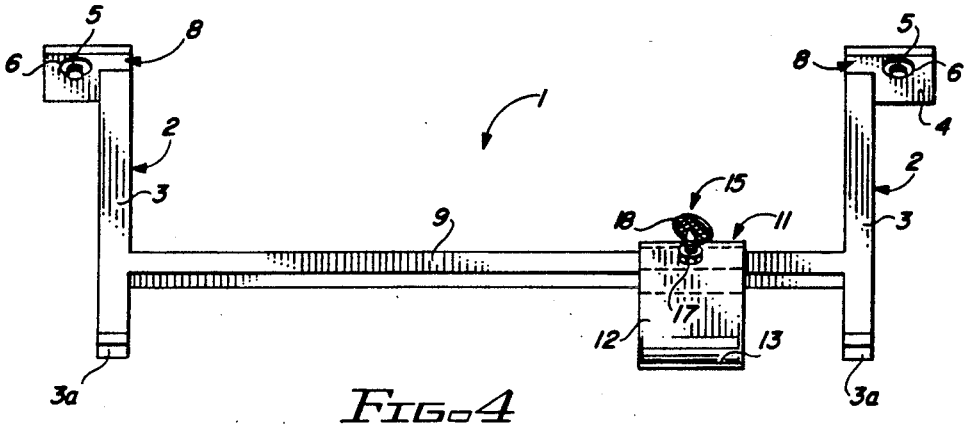
FIG. 4 is a top view of the ladder support illustrated in FIG. 1.

Referring initially to FIGS. 1, 2 and 4 of the drawing, the ladder support of this invention is generally illustrated by reference numeral 1 and includes a pair of parallel legs 2, which are each characterized by a corresponding leg plate 4 for mounting against the gutter mount plate 23 of a gutter 19 and a leg bar 3, welded or otherwise secured to each leg plate 4 in angular relationship. Each leg plate 4 is provided with an opening (not illustrated) for receiving a lag bolt 5 and a neoprene washer 6 and securing each leg plate 4 tightly against the gutter mount plate 23, as the lag bolts 5 thread into the underlying vertically-oriented facia board 26 of the structure 25. A horizontal crossbar 9 connects the legs 2 intermediate the fixed and extending ends of the legs 2 and in a most preferred embodiment of the invention a bar plug 3*a* is fitted into each extending end of the leg bars 3 of the legs 2, as further illustrated in FIGS. 1, 2 and 4. In another preferred embodiment of the invention a sliding bracket 11 is provided in the ladder support 1 and includes a slide 14, which is sized slightly larger than the crossbar 9 and a bracket plate 12, welded to the slide 14 and terminating in an upward-turned, curved plate lip 13. A thumb screw 15 includes a thumb screw shank 16, fitted with shank threads 16*a*, and extending from a flat thumb screw grip 18 and threaded into a thumb screw nut 17, which is welded to the top of the bracket plate 12. Accordingly, the sliding bracket 11 is designed to traverse the length of the crossbar 9 and seat against one of the ladder legs 31 provided in the ladder 29, illustrated in phantom, to force one of the ladder legs 31 against a leg bar 3 and secure the ladder 29 in upward-standing relationship, with the ladder legs 31 resting against the crossbar 9, as illustrated in FIGS. 1 and 2. The ladder 29 further includes conventional ladder rungs 30, seated in the parallel ladder legs 31 and also illustrated in phantom, and the ladder 29 is so positioned with respect to the crossbar 9 that at least one of the ladder rungs 30 is always disposed above the bracket plate 12 and plate lip 13 of the sliding bracket 11, for reasons which will be hereinafter described.

Figure 5:
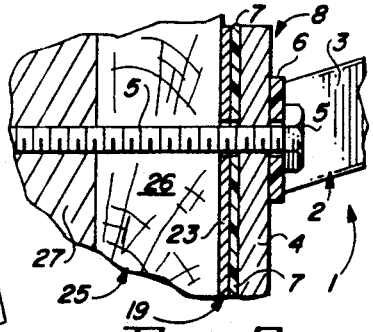
FIG. 5 is an enlarged view of preferred mounting elements of the ladder support illustrated in FIG. 2.

Referring now to FIGS. 2 and 5 of the drawing, in a most preferred embodiment of the invention a quantity of calk 7 is applied to the back of each leg plate 4 before the leg plate 4 is secured to the facia board 26, in order to seal the spaced leg plates 4 against the gutter mount plate 23 of the gutter 19. Furthermore, angle "A" illustrated in FIG. 2 and measured between the leg bars 3 of the legs 2 and the corresponding leg plate 4, is chosen such that the leg bars 3 extend upwardly above the gutter flange 20 and flange lip 21 of the gutter 19. Moreover, the crossbar 9 spans the leg bars 3 of the legs 2, such that the ladder legs 31 of the ladder 29 cannot engage the gutter flange 20 or flange lip 21 to bend or otherwise damage the gutter 19 when a load is placed on the ladder rungs 30 of the ladder 29. Angle "A" is also chosen such that the angle between the ladder legs 31 and the spaced leg bars 3 of the legs 2 is about 90 degrees and the angle "B", measured between each of the ladder legs 31 and the vertical, is in the range of from about 17 to about 19 degrees. It has been found in safety tests that inclining a ladder 29 on a supporting surface (not illustrated) at an angle in the range of from about 17 to about 19 degrees with respect to the vertical is the optimum angle for disposition of the ladder 29 in a safe manner. Accordingly, in a most preferred embodiment of the invention, angle "A" lies in the range of about 90 degrees less 19 degrees, or 81 degrees to about 90 degrees less 17 degrees, or 83 degrees. As further illustrated in FIGS. 2 and 5, in a most preferred installation of the ladder support 1, each of the lag bolts 5 projects through a neoprene washer 6, an opening (not illustrated) drilled in each of the leg plates 4 and through a layer of calk 7, into the facia board 26, to ultimately thread into the end of a rafter 27, which butts against the facia board 26 inside the structure 25. Accordingly, the legs 2 are most preferably deployed on 24 inch centers, such that each of the lag bolts 5 thread into not only the facia board 26, but also the ends of the rafters 27, for additional stability in mounting the ladder support 1 on the structure 25. Furthermore, it will be appreciated by those skilled in the art that the length of the leg bars 3 of the legs 2 depends upon the presence and size of the gutter 19 and therefore, the width of the gutter base 22 and gutter flange 22 and the distance from the flange lip 21 to the gutter mount plate 23. Accordingly, the length of the leg bars 3 may be chosen to locate the crossbar 9 slightly above and outwardly of the flange lip 21 of the gutter 19, to insure that each of the ladder legs 31 of the ladder 29 do not touch the flange lip 21 when weight is brought to bear on the ladder rungs 30. This position of the ladder 29 also insures that no pressure is brought to bear on the shingles 28 located on the roof of the structure 25, the downspout 24, connected to the gutter 19, or the structure wall 25*a*.

Referring again to FIGS. 1-4 of the drawings, in a most preferred embodiment of the invention the crossbar 9 is constructed of ¾ inch square box tubing having a wall thickness of about 5/64 of an inch. Furthermore, the slide 14 element of the sliding bracket 11 is constructed of 1"×1"×14 gauge box tubing which is sufficiently large to slidably fit over the crossbar 9 and facilitate loosening the thumb screw 15, such that the thumb screw shank 16 disengages the underlying crossbar 9 to allow movement of the sliding bracket 11 to any desired position on the crossbar 9 against one of the two ladder legs 31 which engage the crossbar 9. The thumb screw 15 is then tightened by exerting pressure on the thumb screw grip 18 in conventional fashion to engage the end of the shank 16 with the crossbar 9, secure the ladder 29 against one of the leg bars 3 in the position illustrated in FIGS. 1 and 2 and prevent lateral sliding of the ladder 29. As illustrated in FIG. 2, should the ladder 29 inadvertently "kick out", or slide at the bottom with respect to the supporting surface (not illustrated) due to an excessive leaning angle "B", then the plate lift 13 and bracket plate 12 intercept the ladder rung 30 located above the bracket plate 12, to prevent further movement of the ladder 29. Accordingly, the sliding bracket 11 serves not only to laterally stabilize the top portion of the ladder 29 by securing one of the ladder legs 31 against a leg bar 3, but also to prevent sliding of the ladder 29 from the crossbar 9. In another preferred embodiment of the invention a no. 14, two-inch lag bolt 5 is used to mount each of the leg plates 4 against the gutter mount plate 23 and facia board 26 of the structure 25.

It will be appreciated by those skilled in the art that although FIGS. 1-3 and 5 illustrate mounting of the ladder support 1 on a structure 25 having a gutter 19, the structure 25 need not be fitted with a gutter 19 in order to accommodate a ladder support 1. Accordingly, under circumstances where the ladder support 1 is mounted on a facia board 26 not fitted with a gutter 19, the leg bars 3 of the legs 2 may be much shorter than as illustrated in FIGS. 1-3 and 5, since damage to the gutter is not in question. Accordingly, under these circumstances the leg bars 3 should be sufficiently long to prevent the ladder legs 31 of the ladder 29 from contacting the projecting ends of the shingles 28 or the structure walls 25*a* of the structure 25 itself, thereby preventing damage.

In yet another preferred embodiment of the invention, the leg bar 3 of each of the legs 2 is welded to the corresponding leg plate 4 such that approximately a ⅜ inch overlap 8 is created at the welded intersect each of the leg bars 3 and the corresponding leg plates 4, to displace rainwater flowing down the angularly disposed leg bars 3, such that water will strike the leg plate 4 rather than either the gutter mount plate 23 or the facia board 26, depending upon whether a gutter 19 is provided on the structure 25.

In operation, the ladder support 1 of this invention is initially mounted on the facia board 26 of a structure 25 by inserting a pair of no. 14, two-inch lag bolts 5 through corresponding neoprene washers and the openings (not illustrated) in the respective leg plates 4, as well as drilled holes (not illustrated) provided in the gutter mount plate 23 of the gutter 19, under circumstances where a gutter 19 is in place on the facia board 26. The lag bolts 5 are forced through pilot holes (not illustrated) drilled in the facia board 26 and into the protruding ends of a pair of rafters 27, respectively, located on 24-inch centers, as heretofore described, to securely anchor the ladder support 1 on either the gutter mount plate 23 of the gutter 19 or directly on the facia board 26, under circumstances where no gutter 19 is provided on the structure 25. A ladder 29 may then be positioned with the upper segments of the ladder legs 31 resting against the crossbar 9 and under circumstances where the sliding bracket 11 is provided on the crossbar 9, the thumb screw 15 is manipulated in the counterclockwise direction when viewed from the top, to facilitate sliding of the sliding bracket 11 into position against one of the ladder legs 31, and a ladder leg 31 is pushed against a leg bar 3, as illustrated in FIG. 2. The thumb screw grip 18 is then manipulated in the clockwise direction to tighten the thumb screw shank 16 against the crossbar 9 and secure the ladder 29 in upright configuration, such that the ladder legs 31 define approximately a 90 degree angle with respect to each of the leg bars 3 of the legs 2 and describe an angle "B" of from about 17-19 degrees with respect to the vertical. When the ladder 29 is secured to the ladder support 1 in this configuration, it is ready to support the weight of the user and can be used with confidence that there will be no "kicking out" or slippage of the ladder 29 with respect to the supporting surface (not illustrated) and the structure 25. However, should any such "kicking out" or slippage occur, the plate lip 13 and bracket plate 12 of the sliding bracket 11 are positioned beneath a ladder rung 30 and are designed to intercept the ladder rung 30 as the ladder 29 slides, to prevent further ladder slippage. It will be appreciated by those skilled in the art that the ladder legs 31 are located approximately perpendicular to the leg bars 3 against the crossbar 9 not only for stability, but also to prevent application of downward or upward forces on the crossbar 9 and thereby minimize stress on the ladder support 1.

It will be further appreciated by those skilled in the art that the ladder support 1 can be constructed of substantially any material which is sufficiently stiff and strong to support the weight of a ladder 29 and a user. Typically, the ladder support 1 is constructed of a metal such as aluminum, steel or the like, to provide the desired rigidity and strength for the purpose.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A ladder support for spacing a ladder from the facia board of a structure having a gutter, said ladder support comprising a pair of support legs extending to the facia board, each of said support legs having an integral planar mounting leg plate at one end thereof, said leg projecting in angular relationship with respect to the plane of said leg plate, a crossbar connecting said support legs and being attached to said support legs intermediate said one end and a second, distal end, and a slide slidably mounted along said crossbar and a bracket plate extending from said slide and having a curved extending end for engaging a rung of the ladder, should the bottom of the ladder be inadvertently displaced from a supported position, whereby the legs of the ladder normally engage said crossbar in spaced relationship with respect to the gutter.

2. The ladder support of claim 1 further comprising said leg plates having openings for receiving fasteners and mounting said ladder support on the facia board against the gutter.

3. The ladder support of claim 2 wherein said leg plates are attached to said support legs at an angle in the range of from about 81° to about 83° with respect to said horizontal plane.

4. A ladder support, gutter and facia board combination comprising a gutter having a back side wall and a front mounted plate, a facia board attached to the back side wall of said gutter, a pair of support legs each having a first end and a second end and being attached to said mount plate of said gutter, said support legs projecting above the gutter in upwardly-extending, angular relationship with respect to a horizontal plate extending through the facia board, a crossbar connecting said support legs intermediate the first and second ends of said support legs and a slide slidably mounted said crossbar and a bracket plate extending from said slide and having a curved extending portion for engaging the ladder, should the bottom of the ladder be inadvertently displaced and lock means provided in said slide for selectively engaging said crossbar and securing the legs of the ladder in contact with said crossbar, whereby the legs of the ladder normally engage said crossbar in spaced relationship with respect to the gutter.

5. The combination of claim 4 wherein said lock means further comprises a thumb screw threadably carried by said slide in transverse alignment with said crossbar.

* * * * *